United States Patent [19]

Eidler

[11] Patent Number: 4,989,569

[45] Date of Patent: Feb. 5, 1991

[54] FUEL-METERING SYSTEM HAVING A REDUNDANT CONTROL ARRANGEMENT

[75] Inventor: Franz Eidler, Vaihingen, Fed. Rep. of Germany

[73] Assignee: Robert Bosch GmbH, Stuttgart, Fed. Rep. of Germany

[21] Appl. No.: 516,980

[22] Filed: Apr. 30, 1990

[30] Foreign Application Priority Data

May 2, 1989 [DE] Fed. Rep. of Germany ..... 3914458
Jan. 27, 1990 [DE] Fed. Rep. of Germany ..... 4002389

[51] Int. Cl.[5] ..... F02D 41/22
[52] U.S. Cl. ..... 123/479; 123/359
[58] Field of Search ..... 123/479, 359; 364/431.11

[56] References Cited

U.S. PATENT DOCUMENTS

| | | | |
|---|---|---|---|
| 3,834,361 | 9/1974 | Keely | 123/479 |
| 4,414,949 | 11/1983 | Hönig et al. | 123/479 |
| 4,425,889 | 1/1984 | Hachitani et al. | 123/479 |
| 4,748,566 | 5/1988 | Sasaki et al. | 123/479 |
| 4,791,900 | 12/1988 | Buck et al. | 123/359 |

FOREIGN PATENT DOCUMENTS 3539407 5/1987 Fed. Rep. of Germany .

*Primary Examiner*—Andrew M. Dolinar
*Attorney, Agent, or Firm*—Walter Ottesen

[57] ABSTRACT

A fuel-metering system having a redundant control arrangement includes a main controller 12, an auxiliary controller 17, a first microprocessor 10, a second microprocessor 11, a switch-over unit 14, an actuator 15 and a fuel-metering unit 16. The second microprocessor emits a switch-over signal to the switch-over unit in the start phase of the internal combustion engine. The switch-over unit then supplies the actuator 15 with the actuator signal from the auxiliary control loop. A determination is made as to whether the actuator has reached the pregiven desired value. If this is indeed the case, then an indication is provided that the auxiliary controller and the switch-over unit are operating properly. If this is not the case, then the assumption can be made that the auxiliary controller or the switch-over unit is defective. In this case, a fault indication is provided.

8 Claims, 2 Drawing Sheets

FUEL-METERING SYSTEM HAVING A REDUNDANT CONTROL ARRANGEMENT

FIELD OF THE INVENTION

The invention relates to a system for metering fuel to an internal combustion engine. The system controls an actuator which adjusts a fuel control device which meters the fuel. The fuel control device can, for example, be the control rod in a diesel fuel pump or an injection valve device of any desired configuration.

BACKGROUND OF THE INVENTION

A redundant fuel-metering system is disclosed in U.S. patent application entitled "Safety and Emergency Driving Method for an Internal Combustion Engine with Self-Ignition and an Arrangement for the Performance of this Method" having Ser. No. 885,166 and filed on July 14, 1986, now U.S. Pat. No. 4,791,900 and claiming priority from German patent application P 35 31 198.3. This fuel-metering system includes an analog main controller and an analog substitute controller. A comparator continuously determines whether the control deviation remains within a predetermined limit. If the comparator determines that this is not the case, then the comparator emits a switch-over signal which actuates a switch-over unit. The switch-over unit then no longer supplies the output signal of the main controller to the actuator for adjusting the control rod of the fuel pump and, instead, supplies the output signal of the substitute controller. The desired value for both controllers is supplied by a microcomputer.

Published German patent application DE 35 39 407 A1 discloses a fuel-metering system having two microprocessors which both operate as digital controllers. The two processors share the computer load during normal operation. One of the processors computes the desired value for the fuel control and the other microprocessor computes the control deviation and the desired value. In the case of a fault, each of the two processors can maintain an emergency operation as an emergency computer. Among other quantities, the emergency computer then computes the desired value as well as the actuating value for the fuel control with a simplified program.

A fuel-metering system has been in production for several years and includes an analog controller and two microprocessors. One of the microprocessors takes over the function of the digital controller when the analog controller malfunctions. The second microprocessor emits a switch-over signal as soon as the first microprocessor or the analog controller malfunctions. The switch-over signal switches a switch-over unit so that the output signal from the analog controller can no longer be supplied to the actuator for the fuel-control device.

In fuel-metering systems having a switch-over unit and an auxiliary controller for the above-mentioned purpose, the problem is present that the switch-over device or the auxiliary controller can also malfunction. This presents a lack of reliability which should be eliminated.

SUMMARY OF THE INVENTION

The fuel-metering system according to the invention includes a main controller, two microprocessors, an auxiliary controller, an analog-to-digital converter, a switch-over unit and an actuator for readjusting a fuel control device.

As in the known system, the second microprocessor emits the switch-over signal for switching the switch-over unit as soon as the first microprocessor or the main controller becomes defective. In addition, the second microprocessor emits the switch-over signal even when at least one further condition occurs other than those mentioned above, namely, especially during the start phase of an internal combustion engine, the switch-over signal is emitted between the time point of the switch-on of the ignition and the time point when the rotational speed (rpm) of the engine is reached.

For increasing the reliability also with reference to the switch-over unit, the system of the invention does not provide for a second switch-over unit in the manner of the computer and the controller, but instead continuously checks the operational capability of the switch-over unit and of the auxiliary controller. The invention is based on the premise that a fuel-metering system malfunctions if the computer or the controller develops a fault and no auxiliary computer or auxiliary controller is present but that the system could continue to operate when only the switch-over unit malfunctions. The switch-over device then remains in its last position but emits a signal in each position with which the quantity of fuel can be controlled. When the auxiliary controller malfunctions, normal operation with the main controller continues to be possible, however, when an emergency occurs, emergency operation is no longer possible.

The fuel-metering system of the invention affords an especially high operational reliability without being any more expensive than a conventional system. The test operation for the switch-over unit and the auxiliary controller either hardly disturbs or does not at all disturb the course of the fuel control. The quality of the fuel control deteriorates in each short time duration when the test operation is conducted for a short time at predetermined time intervals. On the other hand, no deterioration occurs when the test operation is carried out in the start operation or in overrun phases.

BRIEF DESCRIPTION OF THE DRAWINGS

The invention will now be described with reference to the drawings wherein.

DESCRIPTION OF THE PREFERRED EMBODIMENTS OF THE INVENTION

Figure 1A:
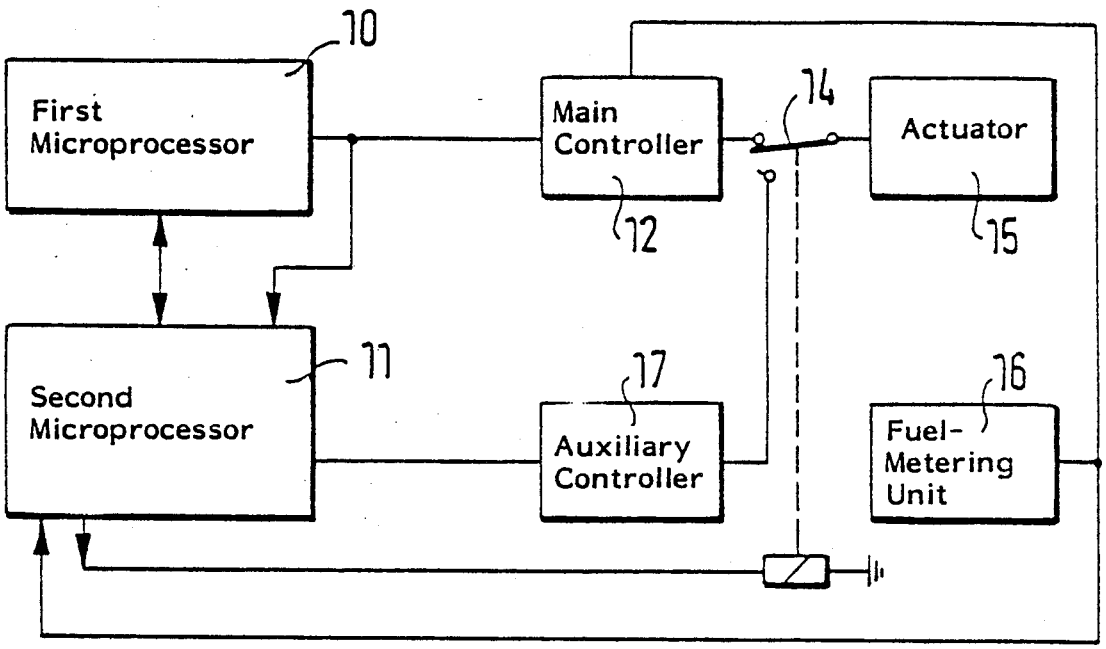
FIG. 1*a* shows a block diagram of a fuel-metering system which emits a switch-over signal for actuating a switch-over unit upon the occurrence of different conditions.

The fuel-metering system of FIG. 1*a* includes a first microprocessor 10, a second microprocessor 11, a main controller 12, an auxiliary controller 17, a switch-over unit 14, an actuator 15 and a fuel-metering unit 16. It is also possible to have one microprocessor in lieu of the two microprocessors shown. In this case, one area of the microprocessor performs the function of the first microprocessor and a second area performs the function of the second microprocessor.

In a proper operation of the system, the first microprocessor 10 computes the desired value for the fuel control and directs this to the main controller 12. For computing the desired value, the first microprocessor 10 continuously receives actual measured values from the engine to be controlled. The second microprocessor 11 also receives these measured values. The main controller 12 additionally receives the corresponding actual value from the fuel-metering unit 16. From the two values, the main controller 12 computes the actuating value which it transmits to the actuator 15 via the switch-over unit 14. The actuator is, for example, the drive for the control rod in a diesel injection pump or is a driver for an injection valve.

The actual value of the fuel-metering unit 16 is supplied also to the second microprocessor 11. This second microprocessor can be simply an emergency-operating computer or it can be such a computer which continuously takes over essential control tasks. In each case, the two computers continuously exchange data with each other and in the one case less data and in the second case more data. The data exchange is illustrated by the double arrow.

A signal line branches off of the line which transmits the desired value from the first processor 10 to the main controller 12. The second microprocessor 11 receives the desired value for the fuel control via this signal line. The second microprocessor also continuously receives the actual value from the fuel-metering unit 16. The second microprocessor determines if only a control deviation of a predetermined magnitude is present between the desired value and the actual value, for example, a difference of 10% should not be exceeded. Transient operations are considered in making this determination. The control described above takes place with the aid of the main controller 12 as long as the particular actual value moves within predetermined limits with respect to the particular desired value. However, if the predetermined limits are exceeded, the auxiliary controller 17 begins to operate and emits an actuating signal. At the same time, the second microprocessor 11 supplies a switch-over signal to the switch-over unit 14 which causes the switch-over unit to switch over to the actuating signal from the auxiliary controller 11. Accordingly, the actuator is supplied with the output signal from the auxiliary controller in lieu of the output signal from the main controller.

The controllers (12, 17) can be configured as analog controllers or as digital controllers. If the controllers (12, 17) are configured as digital controllers, then they can be integrated into the microprocessor. A digital-to-analog converter is arranged upstream or downstream of the controller in dependence upon whether the controller is configured as an analog or digital controller.

Figure 1B:
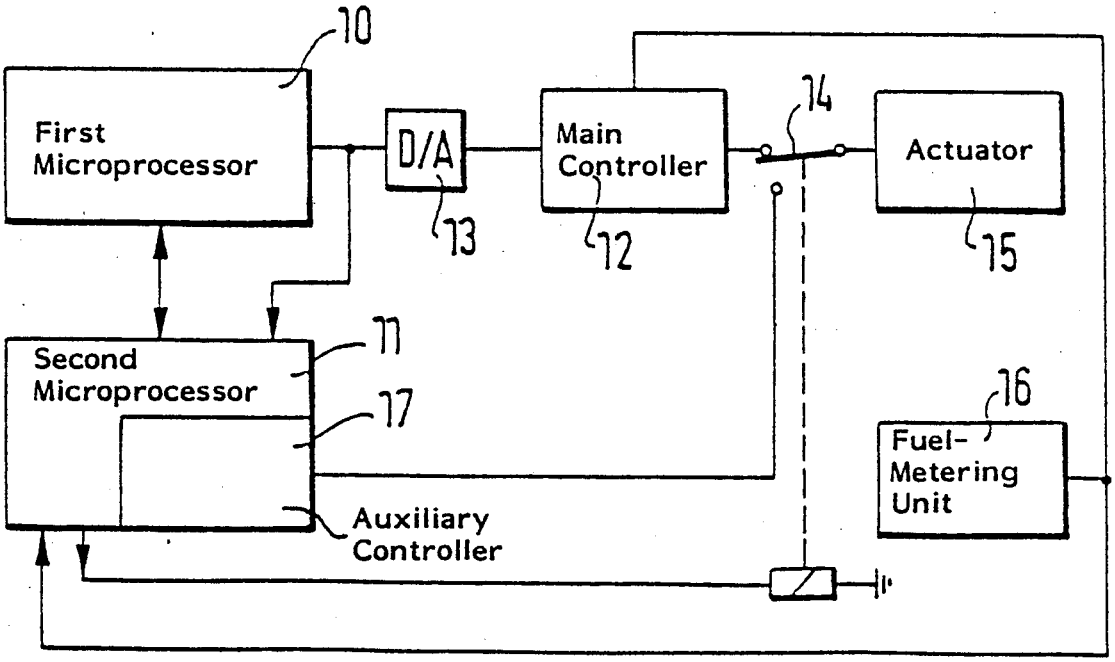
FIG. 1*b* is a block diagram of an especially advantageous embodiment of the invention wherein the auxiliary controller is configured as a digital controller and is integrated into the second microprocessor; and, FIG. 2 shows a flowchart of a test sequence as conducted in the microprocessor of the systems shown in FIGS. 1*a* and 1*b*.

An especially advantageous embodiment of the invention is shown in FIG. 1*b*. In this embodiment, the auxiliary controller is configured as a digital controller and is integrated into the second microprocessor 11. In contrast, the main controller is configured to be analog. The output signal of the microprocessor 10 is supplied to the analog controller via a digital-to-analog converter 13. Corresponding elements in FIGS. 1*a* and 1*b* are identified by like reference numerals. The function of these elements has already been described with respect to FIG. 1*a*.

It is essential that the second microprocessor 11 is so configured that it supplies the switch-over signal also in response to the occurrence of another condition than the one mentioned above, namely, always in the start phase of the engine when the fuel quantity is controlled.

Figure 2:
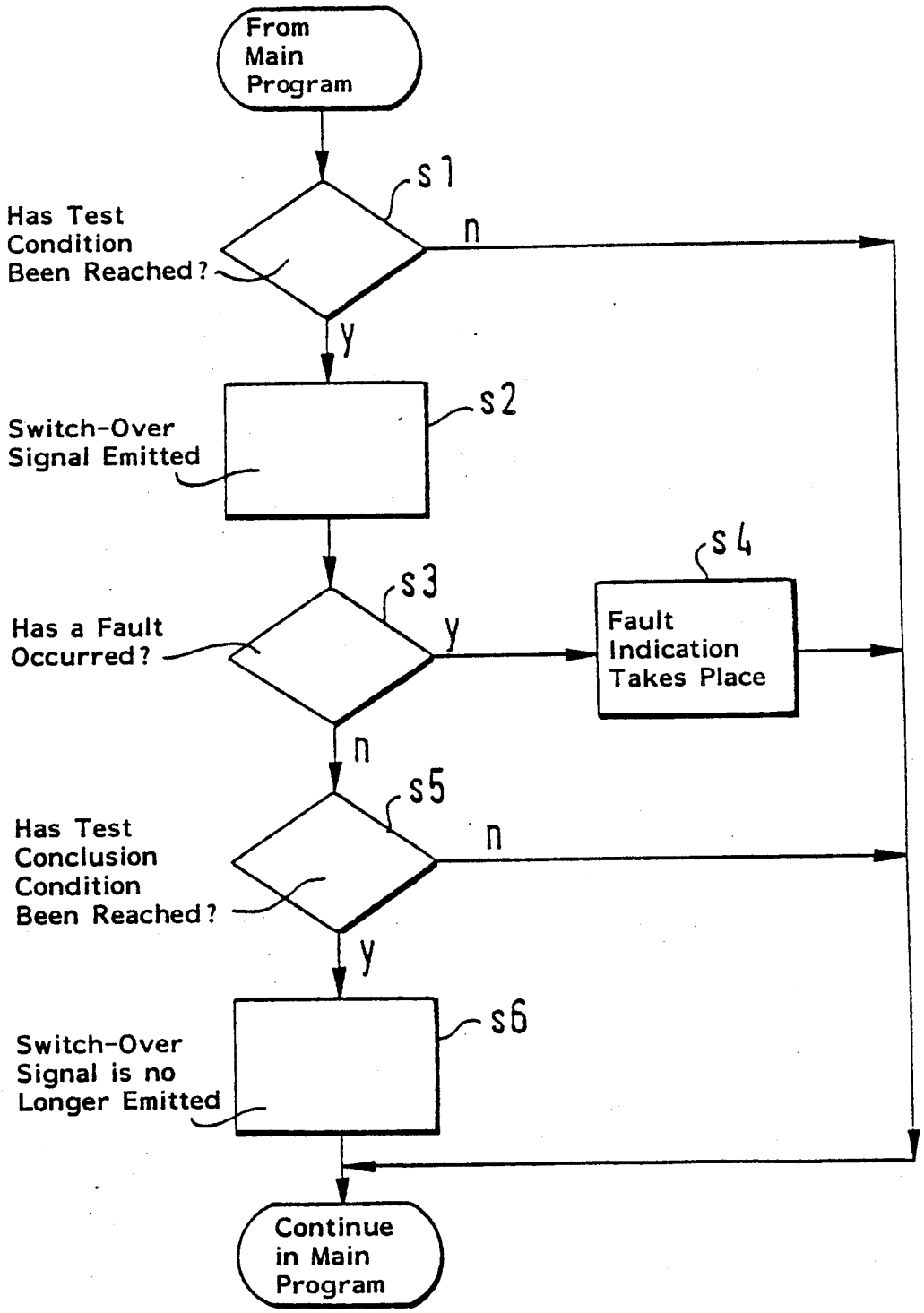

The test sequence according to FIG. 2 is processed with each run-through of the main program. In a step s1, a determination is made as to whether a test condition has been reached. In the example, the condition is whether the start phase is present or not. The start phase is present in that time interval which lies between the time point of the actuation of the ignition key and the time point of reaching a predetermined rotational speed. This rotational speed typically lies 50 to 100% above idle speed. As soon as the increased rotational speed is reached, a switch-over takes place to idle control from a fuel control with increased fuel quantity for starting the engine. A transfer to a further processing of the main program always takes place when the test condition is not reached, that is, after the start phase is ended.

If in contrast, the start condition is reached, that is, the start phase is present, a switch-over signal is emitted in a step s2 and a determination is made as to whether the fuel quantity predetermined for the start condition is reached. For this purpose, the actual fuel quantity actual value is not measured as indicated in the block diagram of FIG. 1; instead, auxiliary variables are examined. In a diesel engine, the determination is made as to whether the actuator reaches a predetermined position.

This position is predetermined by the desired value which does not directly determine the fuel quantity; instead, the desired value determines the desired actuating displacement of the control rod. In contrast, in an engine equipped with fuel injection, a determination is made as to whether a predetermined injection valve actually opens during that particular time duration which is pregiven by a desired value.

In step s3, a determination is made as to whether a fault has occurred. A fault always then occurs when the switch-over unit 14 does not switch in the prescribed manner or when the auxiliary controller is defective. In this situation, the output signal of the microprocessor 11 does not reach the actuator 15 or if the output signal does reach the actuator 15 it does so as a falsified output signal. Accordingly, an actual value is set in the above-mentioned measurement which is not in agreement with the value supplied by the second microprocessor 11. In this case, a fault indication takes place in step s4 and the determination is ended. The vehicle can be driven further in a completely proper manner since the first microprocessor 10 and the main controller 12 are still operational and the switch-over unit 14 transmits the output signal from the main controller 12 to the actuator 15. However, it has been determined that if the first microprocessor 10 or the main controller 12 would become defective, the engine could no longer be operated because one of the switching components between that output terminal of the second microprocessor 11 and the actuator 15 is defective. Accordingly, a fault indication is initiated so that a repair of the fuel-metering system can be made.

If no fault is determined in step s3, a determination is made in step s5 as to whether a test conclusion condition has been reached in the meantime. In the example described, this is the above-mentioned condition that a pregiven rotational speed has been exceeded. If this concluding condition has not been reached, further steps in the main program are carried out until the test sequence of FIG. 2 is reached again. In this time, the switch-over signal is continuously emitted to supply the actuating value of the main control loop to the actuator 15. In contrast, if in step s5 the test conclusion condition is reached, the determination is ended in step s6, that is, the switch-over signal is no longer emitted which causes the switch-over unit 14 to switch over again to the output signal of the main controller 12.

The auxiliary controller and the second microprocessor 11 are only configured as emergency units which do not operate as fast as the first microprocessor 10 or the main controller 12. Fewer conditions are considered when computing this desired value than the desired value computed by the first microprocessor 10. These poorer control characteristics in the auxiliary control loop do not however disturb in the starting phase since in this phase, no rotational speed control takes place.

The test procedure according to FIG. 2 is even then not disturbing when the test condition is that condition as to whether overrun operation is present and when the test conclusion is reached when the overrun operation should again be discontinued. During overrun operation, a small quantity of fuel is predetermined in step s2 and a determination is made in step s3 as to whether this reduced fuel quantity was also adjusted.

The second microprocessor 11 and the auxiliary controller 17 can have the capability and be so fast that they provide a controlled operation having the same quality as the main control loop having the first microprocessor 10 and the main controller 12. Especially in this case, the test sequence according to FIG. 2 can be carried out in the same time intervals in which the control is carried out without a necessity of accepting deteriorated control characteristics. The test condition in step s1 then comprises a determination as to whether a predetermined time duration has passed since the last test sequence.

If the control characteristics in the auxiliary loop are poorer than in the main loop, it is advantageous to select the first-mentioned time interval as large as possible and the second time interval as short as possible and only until a reliable determination has been made as to whether the desired value supplied by the auxiliary control loop reaches the actuator 15. For this purpose, a time interval in the range of a second is adequate.

The switch-over signal is emitted, independently of how a particular test condition is configured for testing the switching component between the second microprocessor 11 and the actuator 15, when it is determined that the main control loop does no longer operate correctly irrespective of whether this is caused by a fault in the first microprocessor 10 or a fault in the main controller 12. To determine a fault in the main loop, the second microprocessor 11 continuously determines whether the actual value supplied thereto is in agreement with the desired value of the first microprocessor 10 within the limits mentioned above. If this agreement is not present, a switch-over signal is emitted. In this case, this signal will therefore indicate a fault while the signal is emitted only as an aid in the test case where an error is usually not present.

It is understood that the foregoing description is that of the preferred embodiments of the invention and that various changes and modifications may be made thereto without departing from the spirit and scope of the invention as defined in the appended claims.

What is claimed is:

1. A fuel-metering system for an internal combustion engine, the fuel-metering system comprising:

a fuel-metering unit for measuring and metering fuel to the engine;

an actuator for adjusting said fuel-metering unit;

first means for supplying a fuel-quantity desired value signal;

main controller means for receiving said fuel-quantity desired value signal and for producing a first drive signal for driving said actuator;

auxiliary controller means for producing a second drive signal for driving said actuator;

switch-over means switchable in response to a switching signal for switching between a first position wherein said main controller means is connected to said actuator and a second position wherein said auxiliary controller means is connected to said actuator; and, second means for supplying said switching signal to said switch-over means for testing purposes so as to check at least one of the following for operational capability: said auxiliary controller means and said switch-over means.

2. The fuel-metering system of claim 1, said main controller means being configured so as to be analog and said auxiliary controller means being configured so as to be digital.

3. The fuel-metering system of claim 2, said auxiliary controller means being integrated into said second means.

4. The fuel-metering system of claim 3, said second means being configured to emit said switching signal when the engine is started.

5. The fuel-metering system of claim 3, said second means being adapted to emit said switching signal until the engine has reached a predetermined rotational speed.

6. The fuel-metering system of claim 3, said second means being configured to emit said switching signal for a short time duration during overrun operation.

7. The fuel-metering system of claim 6, wherein the emission of said switching signal for said short time duration effects metering a small quantity of fuel when said auxiliary controller means and said switch-over means are operating correctly.

8. The fuel-metering system of claim 3, said second means being configured to cause said switching signal to be emitted at predetermined time intervals for respective short time durations.

* * * * *